US007942186B2

(12) United States Patent
Lassiter

(10) Patent No.: US 7,942,186 B2
(45) Date of Patent: May 17, 2011

(54) FABRIC PANEL ADAPTABLE DRAPE, AS CURTAIN, SHADE AND VALANCE

(75) Inventor: Leigh Lassiter, Cathage, NC (US)

(73) Assignee: Ellery Homestyles, LLC., New York, NY (US)

( * ) Notice: Subject to any disclaimer, the term of this patent is extended or adjusted under 35 U.S.C. 154(b) by 477 days.

(21) Appl. No.: 11/177,109

(22) Filed: Jul. 8, 2005

(65) Prior Publication Data

US 2007/0006982 A1 Jan. 11, 2007

(51) Int. Cl.
*A47H 13/14* (2006.01)

(52) U.S. Cl. ..... 160/348

(58) Field of Classification Search ..... 160/349.1, 160/349.2, 348, 84.01, 330
See application file for complete search history.

(56) References Cited

U.S. PATENT DOCUMENTS 928,190 A * 7/1909 Flynn ..... 248/263
2,392,598 A * 1/1946 Lewis ..... 160/123
2,627,918 A * 2/1953 Morris ..... 160/348
2,671,508 A * 3/1954 Morris ..... 160/348
5,566,734 A * 10/1996 Levy et al. ..... 160/84.04
D498,106 S * 11/2004 Johnson et al. ..... D6/575
7,213,633 B2 * 5/2007 Petronzio ..... 160/330
2003/0116287 A1 * 6/2003 Titus et al. ..... 160/348
2005/0199356 A1 * 9/2005 Nien et al. ..... 160/348

* cited by examiner

*Primary Examiner* — Blair M. Johnson
(74) *Attorney, Agent, or Firm* — Ostrolenk, Faber, Gerb & Soffen, LLP

(57) ABSTRACT

A fabric panel adapted for use selectively as a drape, curtain, shade or valance. The panel has a loop at the upper edge region for receiving a curtain rod. A strip extending across the panel down from the upper end. Two fastening tie receivers are disposed on the panel at about the height of the strip. A respective one or more strip ties around the bottom edge region of the panel and also is passed through fasteners at the strip so that the ties may be tightened for selectively raising the bottom of the panel at a plurality of locations across the panel to a varying extent to expose the area beneath the shade to a varying selected extent, or to raise the bottom of the panel higher to a fixed location so that the panel with the ties raising the panel may serve as a valance. A tie around the panel and off to the side defines the panel into a curtain.

7 Claims, 1 Drawing Sheet

FABRIC PANEL ADAPTABLE DRAPE, AS CURTAIN, SHADE AND VALANCE

BACKGROUND OF THE INVENTION

The present invention concerns a panel of fabric adapted to be hung and which a user may selectively adapt to serve as a drapery, a pull back curtain, a shade over a window or a valance.

A drape may hang over a window, mirror, opening or doorway (hereafter only a window is recited although the others are included) and is suspended from the top, typically by a rod. A curtain is an elongate panel typically also suspended from a rod. A pull back strap, or tie, or the like positioned between the top and bottom of the height of the curtain is attached to a wall or a frame around a window or and encircles the curtain panel and pulls it back to reveal the window behind the curtain. A shade is typically a single panel which covers a window and is raised to a selected extent revealing a selected portion of the window below the shade. A valance is or includes fabric that is held above or upraised toward the top of a window and frames the top and out to the sides of the window and is typically not raised or lowered but is at a fixed upraised height.

A window might have one or more of the foregoing drapery, curtain, shade and valance. It may be desirable that as many of them as there are at or over a window be matching and have an identical fabric and panel. Typically, a fabric panel is adapted for primarily one use as either a drapery, a pull back curtain, a shade or a valance. But, if each of the foregoing may be made from the same basic fabric panel, this reduces the number of different size and shape panels pieces that need be initially manufactured, and for the retailer, this reduces the variety of inventory and therefore the overall amount of inventory or panels that should be maintained to satisfy customer requirements for all these different types of window coverings and also makes it easier for a customer who may buy the necessary number of panels for providing the number required of draperies, curtains, shades and valances. Heretofore, a panel designed for all of the foregoing uses was not known commercially to the inventor hereof.

SUMMARY OF THE INVENTION

It is an object of the present invention to provide a fabric panel adaptable by the ultimate user or installer as any of one or more of a drape, curtain, shade and valance.

According to the invention, a panel that is adaptable to serve as a drape, curtain, shade or valance comprises an elongate panel of a material which may be shirred at its top end and/or which may be pleated as is often seen in drapery and curtains.

The upper edge of the panel may be provided with a device for receiving a conventional curtain rod. That device might include a folded over loop of the panel material at the upper edge, or rings attached at the upper edge or other types of curtain rod engaging fasteners attached at the upper edge of the panel.

A distance down from the upper edge of the panel, spaced downward a typical distance about the height that a curtain rod is typically positioned above the upper edge of a window, doorway or other opening, an extra reinforcing and tie attachment covering strip extends across the panel parallel to the rod receiving upper edge above the strip. At at least two locations at the height of the strip across the panel tie or loop receivers are provided, e.g. in the form of holes, generally button hole shape, through which a tie may be threaded.

At least two ties are provided for possible use with the panel. Each tie may be an elongate thin strip, possibly string-like, which may be of the fabric of the panel and be of sufficient thickness to be decorative and may have the same pattern as on the fabric panel or be of another material, like a rope, chain, etc. It should be sufficient to engage the panel and to be adjustable for adjusting the shade or valance to a selected height or to different heights. The tie is useful for selecting the height of the shade and the height of the valance and holding them at the selected heights. The tie is also useful as a tieback for the curtain so that the curtain is pulled sideways and perhaps slightly upraised at an intermediate region of its length. The tie may have a knot or bow applied to it to close it into a loop. That may be positioned hidden behind the strip or permitted to hang down.

Other features and advantages of the present invention will become apparent from the following description of the invention which refers to the accompanying drawings.

DETAILED DESCRIPTION OF PREFERRED EMBODIMENTS

Figure 1:
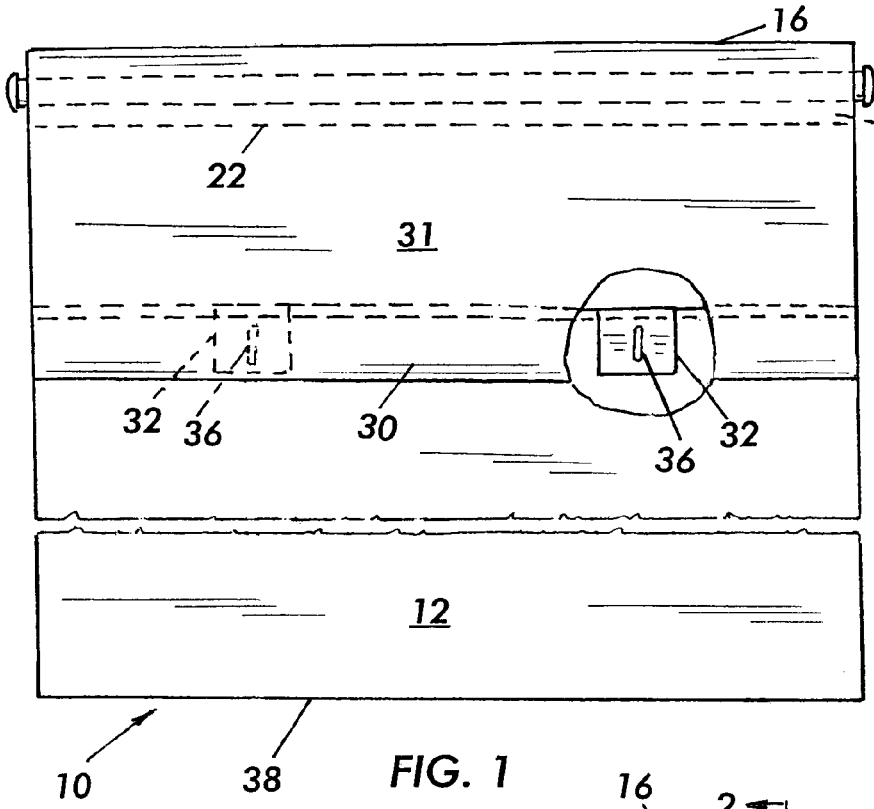
FIG. 1 is a view of a panel according to the invention.

FIG. 1 is a partially fragmentary view of a single panel 10 which may be used as a drape over a window, mirror, doorway or opening. Hereafter only a window is mentioned, as representative, but the panel hereof may be used with any of the other items mentioned or still others. The panel is a single panel of conventional flexible fabric of any sort which is able to be folded over and shaped and which may serve as a drape. The fabric may be of a textile material, or a non-woven, or netting, or plastic, etc. as the particular creator and manufacturer may select. It is only necessary that the fabric be capable of being shaped and sized as required to serve as one of the four types of coverings and is capable of being adapted with a tie or an extra strip, as described below. The fabric panel 12 has a width of a drape or of a curtain or of a shade or valance, as the designer may select. It has the height of a typical curtain rod down to the lower end of a drape or curtain or shade as a manufacturer may select.

The upper edge region 16 of the panel 10 in FIG. 1 is folded over to define a loop 18 which is fastened on its edge at 22 to the panel 12 to define the loop 18. The loop is open-ended at its lateral sides so that the panel may be threaded onto a typical drapery rod or curtain rod 24 which is passed through the loop 18. Other types of fastenings between the upper edge region of the panel 10 and a support for it, including hooks on one and hook receivers on the other, rings or hooks on the upper edge region of the panel for being attached to a rod, etc., may be provided.

At a distance below the upper edge region 16 and the loop 18, an extra strip 30 passes across the panel 10 from one side to the other. That strip defines between the loop 18 and the strip 30 an upper region 31 of the panel which essentially remains in its original shape and condition, while the region below the strip 30 may be reshaped, accordioned, pleated, lifted, etc.

At the height of the strip 30 and hidden beneath it are at least one, preferably a plurality, and typically two tie receiving fasteners 32 which are adapted to cooperate with ties 40 used for setting the final selected form of the panel. Each fastener 32 may comprise a generally enlarged, button hole shaped opening 36 through which a tie may be passed so that the tie can hold up the bottom of the panel 12 at a selected height. The bottom edge region 38 of the panel, like the rest of the panel, is of a thin and flexible material, so that the panel may be lifted and raised sideways to define a curtain, raised selectively to define a shade or raised to a fixed height to define a valance.

At least one, preferably a plurality and typically two ties 40 are provided with the panel 10 adapted for tying the panel to define it as one of a curtain, shade or valance. A drape form as shown in FIG. 1 would not require a tie, since the drape hangs straight down without being tied up or pulled to the side or raised.

Figure 3:
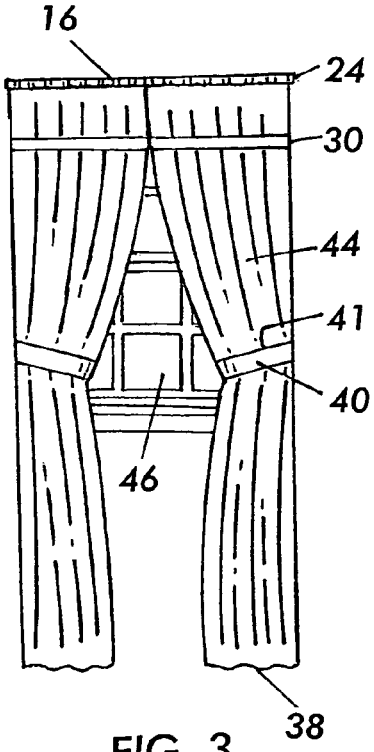
FIG. 3 shows two of the panels in the form of curtains over a window.

Referring to FIG. 3, to convert the panel 10 to one curtain 44 over a window 46, the upper edge region 16 is on a curtain rod 24. One tie 40 is wrapped around the panel to define a loop at 41 at a distance down from the strip 30 and distance up from the bottom edge region 38 of the panel, and the tie 40 is sized or tightened to draw and raise the curtain toward one side. The tie would be attached on a wall adjacent the window or a frame around the window to select the height of the tie where the tie loop 41 and the panel captured by the loop defines a curtain, as shown in FIG. 3.

Figure 2:
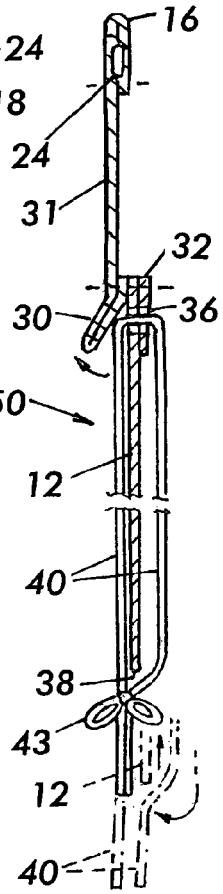
FIG. 2 shows a side cross-sectional view of the panel with a tie fastened on it, taken at 2-2 in FIG. 4.
Figure 4:
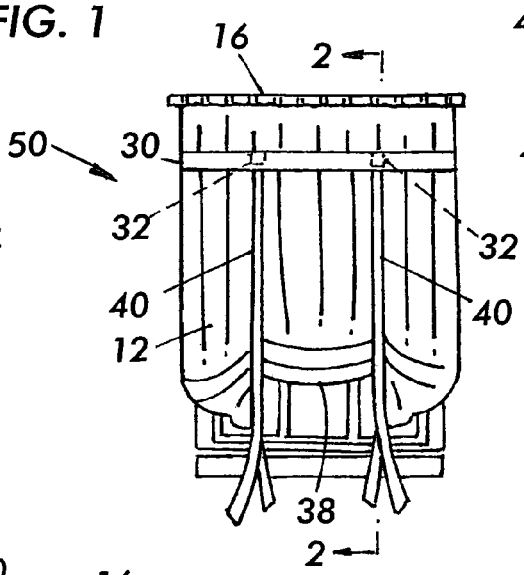
FIG. 4 shows one of the panels adapted as a shade over a window.

FIGS. 2 and 4 show the panel adapted as a window shade 50. The upper edge region 16 thereof is on a rod 24 as in the drape and curtain embodiments. In the illustrated embodiment, there may be at least two of the tie fasteners 32 spaced apart over the width of the panel. The strip 30 covers the fasteners 32 so that when the panel is placed over the window, the fasteners are not seen by persons in the room where the shade is disposed. Each tie 40 forms a loop through one of the fastening devices 32 and around the bottom edge region 38 of the hanging panel. Both ties 40 are tightened to an extent so that the bottom edge region is raised to the same extent at both ties, raising the bottom edge of the panel to a selected extent for the shade. As the panel is raised, it may be accordion pleated either as a result of the nature of the fabric or by a person forming or supervising formation of pleats. The shade may achieve the appearance of a balloon shade because of the manner in which its bottom end is folded up. The tie is a strip, so that it is formed into a loop by joining its free ends, e.g., by a knot or a bow as at 43. In FIG. 4, the ends of the tie are positioned to hang down as a direction. Alternatively, the ends and the knot may be positioned under and hidden behind the strip 30 and behind the shade.

Figure 5:
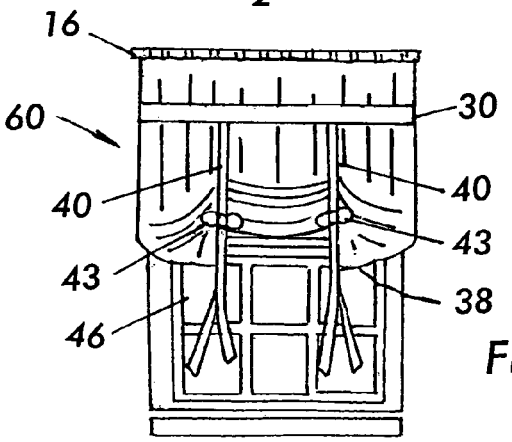
FIG. 5 shows one of the panels adapted as a valance over a window.

The valance 60 shown in FIG. 5 need not differ significantly from the shade 50 in FIG. 4, except that the bottom edge region 38 of the panel is raised considerably higher in the valance embodiment than in the shade embodiment, since a valance is normally at the top of a window, whereas a shade may be positioned at any selected height over a window from below to fully cover it, partially cover it, expose almost all of it, or to expose all of it.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A drapery panel comprising:

a panel of flexible material having a length and a width and having an upper edge region configured to be secured to a supporting structure, the panel of flexible material having a bottom region distanced from the upper edge region, and the panel of flexible material further having an upper region located between the upper edge region and the bottom region;

a strip affixed to the panel of flexible material and extending horizontally across the entire width of the panel of flexible material, the strip separating the upper region of the panel of flexible material from the bottom region defining a flap and overlapping a portion of the bottom region;

a tie operable to secure the bottom region in a raised position and operable to select a height of the bottom region when the bottom region is raised to the raised position;

at least one fastener positioned on the panel of flexible material, the tie connected to the portion of the bottom region and the fastener at the same height as under the strip, the fastener being operable to receive and secure the tie to the panel of flexible material the point of connection of the portion and the fastener located at the same height of and behind the overlapping flap.

2. The drapery panel of claim 1, wherein the at least one fastener comprises a hole formed therein under the strip, the hole being configured to allow the tie to be passed therethrough to be secured to the panel of flexible material.

3. The drapery panel of claim 1, wherein the panel of flexible material comprises at least one of accordion folds and pleats formed from side to side of the panel of flexible material.

4. The drapery panel of claim 1, wherein the upper edge region comprises a curtain rod receiver.

5. The drapery panel of claim 4, wherein the curtain rod receiver comprises a folded over loop of a material of the panel at the upper edge region of the panel.

6. The drapery panel of claim 1, wherein the upper edge region comprises a holder for holding the panel on a suspension support.

7. The drapery panel of claim 1, wherein the tie comprises the same material as the panel of flexible material.

* * * * *